US005786544A

United States Patent [19]

Gill et al.

[11] Patent Number: 5,786,544

[45] Date of Patent: Jul. 28, 1998

[54] WARHEAD PROTECTION DEVICE DURING SLOW COOK-OFF TEST

[75] Inventors: Moshe Gill, Haifa; Itzhak Avnon, Kiryat Shmuel; Yehuda Katz, Haifa; Tamar Yarom, Kiryat Bialik, all of Israel

[73] Assignee: State of Israel—Ministry of Defence, Armament Development Authority, Rafael, Haifa, Israel

[21] Appl. No.: 659,756

[22] Filed: Jun. 6, 1996

Related U.S. Application Data

[63] Continuation-in-part of Ser. No. 370,810, Jan. 10, 1995.

[30] Foreign Application Priority Data

Mar. 2, 1994 [IL] Israel ..... 108.819
Sep. 17, 1995 [IL] Israel ..... 115.328

[51] Int. Cl.[6] ..... F41A 9/00

[52] U.S. Cl. ..... 102/481; 102/293; 102/473; 60/223; 60/253

[58] Field of Search ..... 102/293, 473, 102/481, 499, 500; 60/39.09, 39.1, 223, 253, 254, 256

[56] References Cited

U.S. PATENT DOCUMENTS

| | | | |
|---|---|---|---|
| 3,173,364 | 3/1965 | Nordzell | 102/481 |
| 4,084,512 | 4/1978 | San Miguel | 102/481 |
| 4,478,151 | 10/1984 | Vetter et al. | 102/481 |
| 4,597,261 | 7/1986 | Dolan | 60/223 |
| 4,911,795 | 3/1990 | Oliff, Jr. | 60/253 |
| 4,961,313 | 10/1990 | Dolan | 60/223 |
| 5,038,686 | 8/1991 | Zulkoski et al. | 102/481 |
| 5,044,154 | 9/1991 | English, Jr. et al. | 60/223 |
| 5,129,326 | 7/1992 | Brogan | 102/481 |
| 5,166,468 | 11/1992 | Atkeson | 102/481 |
| 5,206,456 | 4/1993 | Pracchia et al. | 102/481 |
| 5,228,285 | 7/1993 | Van Name et al. | 60/253 |
| 5,361,703 | 11/1994 | Braithwaite | 102/481 |
| 5,369,955 | 12/1994 | Van Name et al. | 60/253 |
| 5,398,498 | 3/1995 | Mort et al. | 60/223 |
| 5,466,537 | 11/1995 | Diede et al. | 102/481 |

FOREIGN PATENT DOCUMENTS

| | | | |
|---|---|---|---|
| WO 90/01635 | 2/1990 | WIPO | 60/39.09 |

*Primary Examiner*—Harold J. Tudor
*Attorney, Agent, or Firm*—Cowan, Liebowitz & Latman, P.C.

[57] ABSTRACT

A device for imparting non-explosive and non-propulsive properties to a warhead during a slow cook-off test, which comprises a pyrotechnic pellet located inside a tube having a predetermined ignition temperature of at least 130° C. but below the violent ignition temperature of the material under slow cook-off conditions, whereby the venting holes present in the aft closure of said tube, are covered by a composite material that loses its strength below the predetermined temperature, causing a pressure relief and a non-propulsive burning of said warhead.

4 Claims, 2 Drawing Sheets

WARHEAD PROTECTION DEVICE DURING SLOW COOK-OFF TEST

This is a Continuation in Part to our Patent Application Ser. No. 08/370,810, filed on Jan. 10, 1995, now pending.

The present invention relates to a safety mechanism for warheads. More particularly, the invention relates to a protective slow cook-off mechanism for providing an automatic protection by ignition of the warhead to be nonexplosive and non-propulsive.

BACKGROUND OF THE INVENTION

The slow cook-off test is a well-known test included in the Insensitive Munitions (IM) test program. The purpose of this program is to develop munitions which fulfill their performance and operational requirements, while minimizing the violence of the reaction and subsequent damage when subjected to any undesired event.

The slow cook-off test is used to determine the reaction temperature and type, and to measure the overall response of major munition subsystems to a gradually increasing thermal environment. This test consists of subjecting the respective item to be tested, to a gradually increasing temperature at a rate of 3.3° C/h until a reaction occurs.

A typical weapon system contains a warhead, which includes an encased explosive charge and a fusing subsystem for activating the charge. Warheads, in general, are divided into three categories, namely shaped charges, fragmentation warheads and penetrators. With respect to their ability to pass the IM tests, warheads are classified as light medium and heavily-confined warheads. Penetrators are usually heavily and totally confined. This confinement causes problems in relation to thermal stimuli, and especially to a slow cook-off test.

The item to be tested may be preconditioned at the munition's upper environmental temperature limit for about eight hours prior to the start of the test.

In order to avoid a violent reaction during a slow cook-off test, penetrates generally are filled with insensitive explosives means, such as Insensitive Plastic Bonded Explosives (IPBX), that are isolated from the casing by a cavity liner. In addition to the IPBX explosive, a special design of venting holes in the warhead casing is suggested in order to avoid an undesired reaction, resulting in a burning of the explosive instead of its explosion during the temperature rise. Several options for a venting design are mentioned in the literature. One option, relates to a warhead aft plate made of a composite material, which is softened and removed at a high temperature and provides a full venting aft. Another suggestion, known as "the composite overwarp design", is to cut holes into the aft portion, to serve as venting means and to use a filamentary composite material to wrap the warhead. However, the above suggestions failed to prevent a violent reaction of the explosive during the slow cook-off test, due to the high pressure and temperature which generally prevail in the confined casing.

In our parent Patent Application Ser. No. 08/370,810, it was described a device for imparting a non-explosive and a non-propulsive property to a rocket motor casing made from a composite material during a slow cook-off test using a particular predetermined pyrotechnic pellet, whereby the composite material of said casing loses its strength at a predetermined temperature, causing a casing failure and a non-propulsive burning of the rocket motor.

It is an object of the present invention to provide an active device for imparting protection during a slow cook off test for warheads. It is another object of the present invention, to provide a device for imparting a non-explosive reaction and a non-propulsive property to a warhead having a heavy metal casing during a slow cook-off test.

BRIEF DESCRIPTION OF THE INVENTION

The invention relates to a device for imparting a non-explosive reaction and non-propulsive property to a warhead during a slow cook-off test, which consists of using a pyrotechnic pellet having an ignition temperature of at least 130° C., but below the violent ignition temperature of the explosive material under slow cook-off conditions, wherein said device is provided with venting holes covered with a composite material, which loses its strength below said pyrotechnic pellet ignition temperature, causing a sufficient venting area to allow for a non-propulsive burning of the warhead explosive charge. The explosive charge, will be ignited and a non-propulsive burning will start when the ambient temperature of the warhead is above 130° C., but below the self-ignition temperature of the warhead explosive charge itself. The most preferred materials for the pyrotechnic pellets are selected from double-based propellants, such as: a mixture of nitroglycerine and nitrocellulose and additives, black powder, mixture of magnesium powder with teflon powder, boron barium chromate and any other known solid propellants and pyrotechnic materials which comply with the above requirement for the ignition temperature. Optionally, in order to improve the physical and chemical properties of the double-based propellants, small amounts of additives may be incorporated as stabilizers.

DETAILED DESCRIPTION OF THE FIGURES

Figure 1:
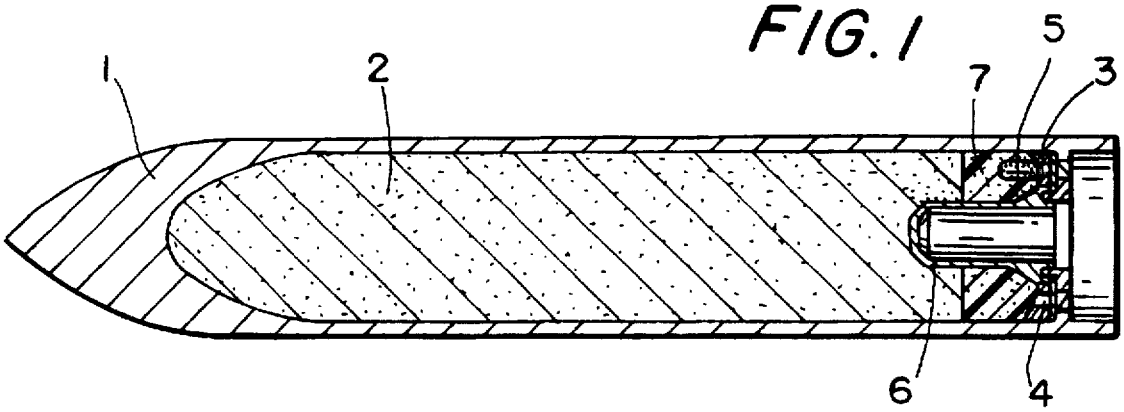
FIG. 1, is a cross-section of a typical penetrating warhead having an aft closure and a fuse well, venting holes and the pyrotechnic pellet.

FIG. 1, illustrates schematically a cross-section of a typical penetrating warhead. The warhead as illustrated, includes a heavy casing (1) usually made of steel, an explosive charge (2), an aft closure (3) with venting holes (4), the pyrotechnical ignition system (5),the fuse well (6) and a foam ring (7) which separates the explosive charge (2) from the pyrotechnic pellet (5).

Figure 2:
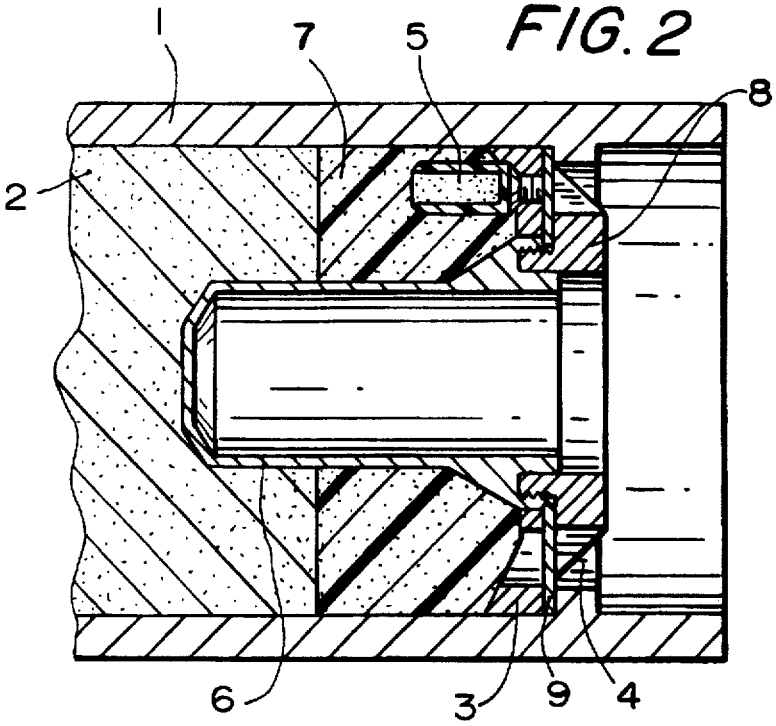
FIG. 2, is a detailed cross-section of a typical rear part of a penetrating warhead containing the pyrotechnic ignition device and the venting holes according to the present invention.

FIG. 2 shows the detailed rear part of the penetrator. The aft closure (3) is mounted coaxially in casing (1) and held in place by an aft nut (8). The venting holes (4), located in the aft closure are covered by plates (9) made from a composite material.

Figure 3:
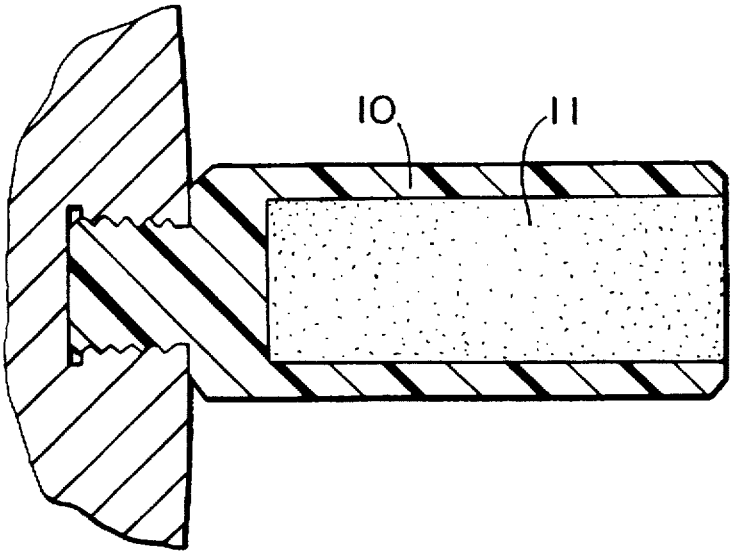
FIG. 3, is a cross-section of a typical pyrotechnic pellet according to the present invention.

FIG. 3, illustrates the pyrotechnic pellet (5) which is located inside a plastic tube (10) which itself is threaded in the aft closure (3). The pyrotechnic pellet material (11) possesses a predetermined ignition temperature, which ignites the explosive charge by the hot gas and particles when the temperature reaches the right value.

DETAILED DESCRIPTION OF THE INVENTION.

According to the invention, when the temperature rises during the slow cook-off test, the explosive material expands axially while the foam ring (7) shrinks. The explosive expansion and the foam shrinkage decrease the distance between the explosive material and the pyrotechnic pellet. When the temperature in the slow cook-off oven reaches the predetermined value, the pyrotechnic thermal pellet is ignited. The hot gases and particles resulting from the pellet burning ignite the explosive material. The venting hole covers are made from a composite material which includes a resin and a fiber, the resin having a softening point of about 120° C. In this manner, at a predetermined temperature of above 120° C., the resin will be significantly weakened. As a consequence, the explosive material will burn non-propulsively at a pressure close to atmospheric pressure, due to the sufficient venting area which prevails therein. Generally, the pyrotechnic pellet has an ignition temperature in the range of between 130° to 140° C. A most preferred pyrotechnic material is boron-barium chromate.

A design description of a typical ignition pellet will be as follows:

Internal diameter of the tube, about 10 mm.

Internal length of the tube, about 30 mm.

The tube contains one pellet, with the above dimensions, consisting of a suitable pyrotechnic or propellant material.

The invention will be hereafter illustrated by the following Example:

Several slow cookoff tests were conducted to verify the present invention. The tests were made in various dimensions. Eight half-scaled tests, where the warheads contained about 8 kg of explosive charge, were successfully performed. In all tests three safety devices were mounted at the aft closure. The explosive was initiated and started its burning when the aft closure temperature was in the range of 130° C.–140° C. After completion of the sub-scaled tests, two full-scale tests were performed. A full-scale warhead was used, 1500 mm long, about 300 mm in diameter, weighing about 250 kg. Both warheads passed the slow cookoff tests successfully, with the explosive starting a mild burning reaction at about 140° C. (aft closure temperature).

It should be understood, that the above description with the data provided, are given only for a better illustration of the invention, without limiting its scope as covered by the appending Claims. A person skilled in the art, after reading the present specification will be in a position to insert slight modifications thereof without being outside the scope of the invention as stipulated in the attached Claims.

We claim:

1. A device for imparting non-explosive and non-propulsive properties to a warhead containing an explosive material during a slow cook-off test, which comprises a pyrotechnic pellet having a predetermined ignition temperature of at least 130° C. but below the violent self ignition temperature of the warhead explosive material under slow cook-off conditions, whereby venting holes are present in the venting holes are aft closure of said warhead laterally spaced from a fuse well covered by a composite material that loses its strength below said predetermined ignition temperature, causing a pressure relief and a non-propulsive burning of said warhead through said venting holes, and said pyrotechnic pellet is located adjacent a venting hole.

2. The device according to claim 1, wherein the predetermined ignition temperature of the pyrotechnic pellet is in the range of 130° C. to 140° C.

3. The device according to claim 1, wherein said pyrotechnic pellet is located in a plastic tube which is treated in the aft closure of the warhead.

4. The device according to claim 1, wherein said pyrotechnic pellet is boron-barium chromate.

* * * * *